US007360590B2

(12) United States Patent
Kossa et al.

(10) Patent No.: US 7,360,590 B2
(45) Date of Patent: Apr. 22, 2008

(54) ENERGIZED THERMOPLASTIC SEALING ELEMENT AND METHOD OF USE

(75) Inventors: Edward Kossa, Huffman, TX (US); Rafael Ramirez, Houston, TX (US); Richard P. Rubbo, Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 11/118,013

(22) Filed: Apr. 29, 2005

(65) Prior Publication Data

US 2006/0243457 A1 Nov. 2, 2006

(51) Int. Cl.
*E21B 33/128* (2006.01)

(52) U.S. Cl. ..... 166/119; 166/196; 277/342

(58) Field of Classification Search ..... 166/387, 166/119, 120, 180, 195, 196, 123, 179; 277/327, 277/336, 342, 340
See application file for complete search history.

(56) References Cited

U.S. PATENT DOCUMENTS

| | | | | |
|---|---|---|---|---|
| 2,449,514 | A * | 9/1948 | Scoville, Jr. | 277/341 |
| 3,554,280 | A * | 1/1971 | Tucker | 166/134 |
| 3,666,010 | A * | 5/1972 | Harris | 166/134 |
| 4,438,933 | A | 3/1984 | Zimmerman | 277/9.5 |
| 4,441,721 | A * | 4/1984 | Harris et al. | 277/342 |
| 4,548,265 | A | 10/1985 | Luke | 166/140 |
| 6,598,672 | B2 * | 7/2003 | Bell et al. | 166/118 |
| 6,863,278 | B2 | 3/2005 | Morvant | 277/602 |
| 2004/0055758 | A1 * | 3/2004 | Brezinski et al. | 166/384 |
| 2005/0072579 | A1 * | 4/2005 | Gambier | 166/387 |
| 2005/0161232 | A1 * | 7/2005 | Patel et al. | 166/386 |
| 2005/0189121 | A1 * | 9/2005 | Doane et al. | 166/387 |

* cited by examiner

*Primary Examiner*—David Bagnell
*Assistant Examiner*—Sean D Andrish
(74) *Attorney, Agent, or Firm*—Shawn Hunter

(57) ABSTRACT

A packer element for use in forming a fluid pressure barrier within a wellbore. The packer element uses a thermoplastic component to accomplish the seal against the interior diameter of a surrounding tubular and an energizing component that is preferably formed of elastomeric material. The thermoplastic component of the packer element provides a sealing surface and defines an energizing chamber within. An energizing chamber is defined within the thermoplastic component and contains energizing elements that, when axially compressed, will urge the sealing surface of the thermoplastic component into sealing engagement with the surrounding tubular.

19 Claims, 2 Drawing Sheets

ENERGIZED THERMOPLASTIC SEALING ELEMENT AND METHOD OF USE

BACKGROUND OF THE INVENTION

1. Field of the Invention

The invention relates generally to wellbore packer assemblies and, in particular aspects, to the design of sealing elements that are carried upon such packer assemblies.

2. Description of the Related Art

Traditional packers are comprised of an elastomeric sealing element and at least one mechanically set slip. Typically, a setting tool is run in with the packer to set it. The setting can be accomplished hydraulically due to relative movement created by the setting tool when subjected to applied pressure. This relative movement causes the slips to ride up on cones and extend into biting engagement with the surrounding tubular. At the same time, the sealing element is compressed into sealing contact with the surrounding tubular. The object of sealing elements in general is to seal fluid pressure between the outer radial surface of a packer and the internal surface of a surrounding casing or tubing.

Elastomeric sealing elements have traditionally been used with packer devices because they are able to be energized into a compressive sealing position against a surrounding tubular member. However, elastomers are vulnerable to extreme temperatures and many chemicals that are often present in wellbores. As a result, they can degrade over time and lose the ability to provide an effective seal.

Thermoplastic polymers, such as TEFLON® (polytetrafluoroethylene) polymer or PEEK (polyetheretherkeytone), have not traditionally been considered to be good candidates for use as a packer sealing element. These materials, while resistant to chemical attack and able to withstand extreme temperatures, are relatively stiff and difficult to urge into a sealing engagement that is lasting. Attempts have been made in the past to form sealing elements from a thermoplastic such as TEFLON® (polytetrafluoroethylene) polymer. U.S. Pat. No. 4,548,265, issued to Luke, for example, describes a thermal packer that is used in welibores that are expected to have high temperatures and pressure conditions. The '265 patent is owned by the assignee of the present invention and is herein incorporated by reference. The thermal packer in the Luke patent, however, uses a non-resilient, non-energizing, multi-component packing assembly. As such, it is not useful for long term sealing arrangements because it cannot be effectively energized into a sealing position.

The present invention addresses the problems of the prior art.

SUMMARY OF THE INVENTION

The invention provides an improved packer element for use in forming a fluid pressure barrier within a wellbore. The packer element uses a thermoplastic component to accomplish the seal against the interior diameter of a surrounding tubular. Additionally, the packer element includes an energizing component that is preferably formed of elastomeric material. In a preferred embodiment, the thermoplastic component of the packer element provides a sealing surface and defines an energizing chamber within.

An energizing chamber is defined within the thermoplastic component and contains energizing elements that, when axially compressed, will urge the sealing surface of the thermoplastic component into sealing engagement with the surrounding tubular. In a preferred embodiment, there are three energizing elements that are formed of elastomer. The central energizing element is fashioned of a softer elastomer and positioned behind the central portion of the sealing surface. During setting, the softer element is more readily compressed than the other energizing elements, resulting in a greater setting force at the central portion of the sealing surface.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
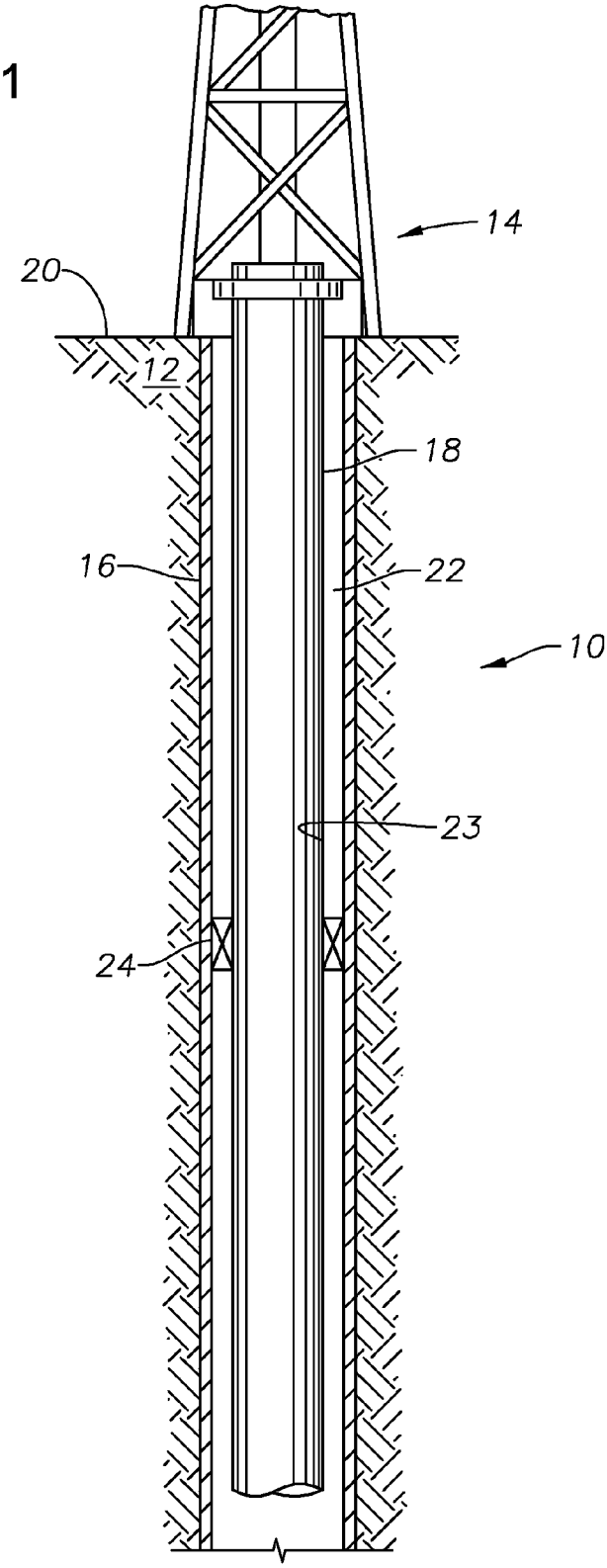
FIG. 1 is a schematic side, cross-sectional view of a wellbore containing a production tubing string with a packer assembly constructed in accordance with the present invention.

FIG. 1 depicts a wellbore 10 that has been drilled through the earth 12 from a wellhead 14. The wellbore 10 contains casing 16 that has been cemented into place in a manner known in the art. A production tubing string 18 extends downwardly from the surface 20. An annulus 22 is defined between the tubing string 18 and the casing 16, and a flowbore 23 is defined within the production tubing string 18. As is well-known, the production tubing string 18 is made up of a number of production tubing sections that are secured together in an end-to-end fashion. A number of tools are typically incorporated into the production tubing string 18, such as production nipples, packers and other anchoring mechanisms. The production tubing string 18 is also used herein to designate the central tubular mandrel upon which the packer assembly is carried. As the make up of production tubing strings is well known in the art and varies from case to case, the details of it are not described further herein. The production tubing string 18 carries a packer assembly, indicated schematically at 24 in FIG. 1, which is constructed in accordance with the present invention.

Figure 2:
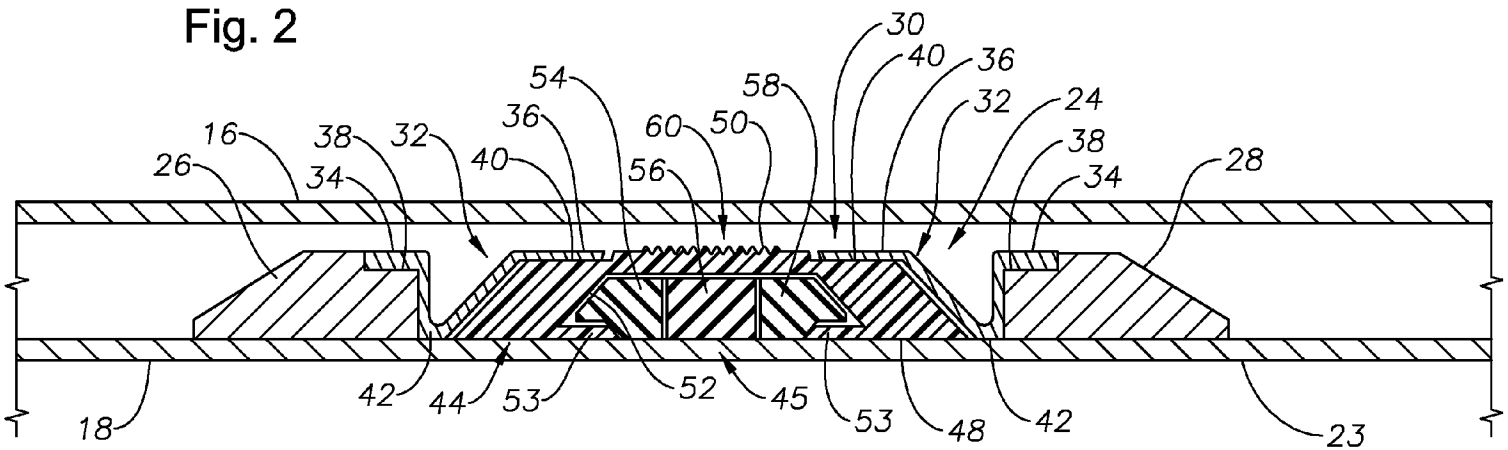
FIG. 2 is a side, cross-sectional view of an exemplary packer assembly having a composite thermoplastic sealing element constructed in accordance with the present invention.
Figure 3:
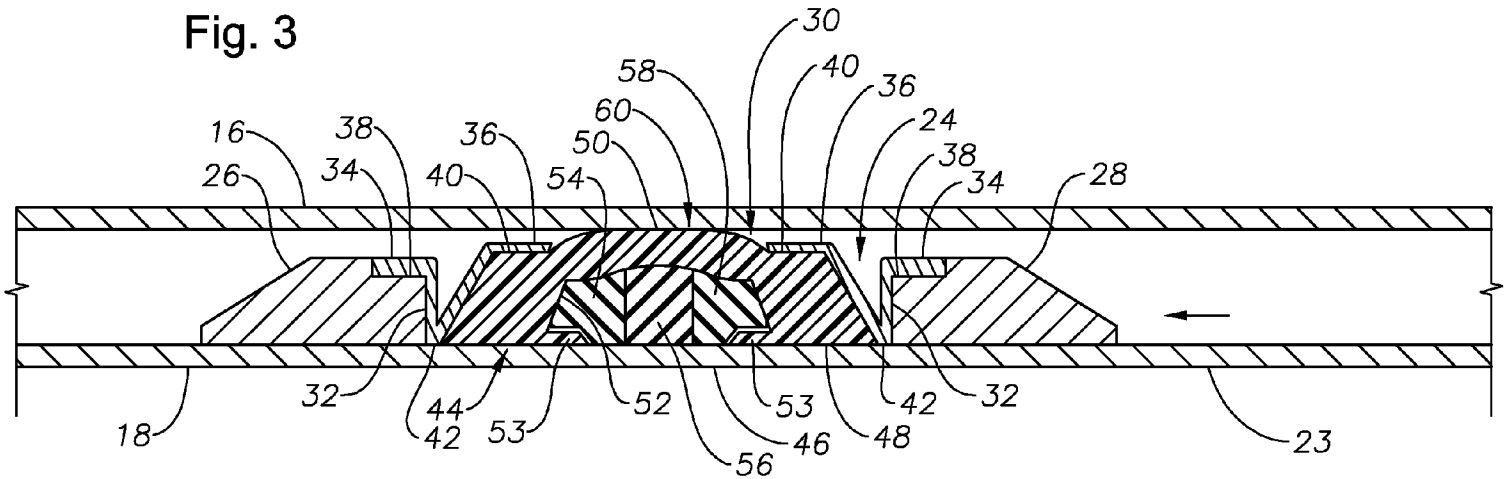
FIG. 3 is a side, cross-sectional view of the packer assembly shown in FIG. 2 now in the set position.

FIGS. 2 and 3 illustrate the packer assembly 24 in greater detail. The packer assembly 24 includes an upper sub 26 and a lower sub 28, each of which surrounds the tubing string 18. The packer sealing element 30 is retained between the upper and lower subs 26, 28 by a pair of flanged retaining rings 32. Each retaining ring 32 includes a sub-engaging flange 34 and sealing element retaining flange 36. The sub-engaging flange 34 extends over a portion 38 of the radially outer surface of one of the subs 26, 28. The sealing element retaining flange 36 extends over a portion 40 of the sealing element 30. The sub-engaging flange 34 and the sealing element retaining flange 36 are joined together by a hinged portion 42 of the retaining ring 32.

The packer sealing element 30 is specially formed to provide a seal that can be energized into sealing engagement with the surrounding casing 16 or another wellbore tubular and, at the same time, remain resistant to chemicals within the wellbore and extreme temperatures. The packer sealing element 30 includes a thermoplastic seal component 44 and an elastomeric component, generally shown at 46. The thermoplastic seal component 44 is fashioned from a thermoplastic material and, more preferably, a chemically inert thermoplastic that is also resistant to degrading in extreme temperatures. Suitable thermoplastic materials for use in forming the thermoplastic component 44 are TEFLON® (polytetrafluoroethylene) polymer and PEEK (PolyEtherEtherKeytone). In the currently preferred embodiment, the thermoplastic component 44 is preferably trapezoidal in cross-sectional shape with the longest side 48 of the trapezoid facing the tubing string 18. The opposite radial side of the thermoplastic component 44 presents a sealing surface 50 that is adapted to from a fluid seal against the casing 16 when pressed into engagement with the casing 16. If desired, the sealing surface 50 may be formed with ridges, as illustrated, to help form a sealing contact.

An annular energizing chamber 52 is defined within the thermoplastic component 44 and the outer radial surface of the production tubing string 18. Interior leg portions 53 of the thermoplastic component 44 help to form the chamber 52. In a presently preferred embodiment, three annular elastomeric energizing elements 54, 56, and 58 are disposed within the energizing chamber 52 and aligned axially next to one another. It is noted that, in accordance with the present invention, there may be more or less than three energizing elements used. In the embodiment shown in FIG. 2, the center energizing element 56 is rectangular shaped, while the other two energizing elements 54, 58 are shaped to conform to the interior shape of the energizing chamber 52. Each of the energizing elements 54, 56, 58 is preferably fashioned from VITON® elastomer or VITON® "ETP" elastomer. Additionally, however, the energizing elements 54, 56, 58 may be fashioned from AFLAS elastomer or nitrile or another suitable elastomer that is resilient and may be readily energized by compression. It is currently preferred that the central energizing element 56 be formed of an elastomer that is softer than the two elements 54, 58 on either axial side of it. This allows for the central element 56 to be more easily compressed and, as a result, the central portion 60 of the packer sealing element 30 will desirably be expanded more greatly than the end portions during setting. This results in a surer seal. An example of the differences in hardnesses between the elements would be for the end elements 54, 58 to have a 90 durometer hardness while the central element 56 has a durometer hardness of 70 (i.e., 90/70/90). Other suitable arrangements would be, for example, 90/80/90, 95/90/95, and 95/80/95.

FIG. 3 depicts the packer assembly 24 in a set position with the packer sealing element 30 having been axially compressed and, thereby, radially expanded into sealing engagement with the casing 16. As shown, the lower sub 28 has been shifted upwardly along the tubing string 18. Shifting of the lower sub 28 may be accomplished using any of a number of well-known techniques for setting, including hydraulic pressure shifting or use of a shifting tool. Setting techniques are described, for example in U.S. Pat. No. 4,548,265. As the lower sub 28 is shifted upwardly, the packer sealing element 30 is axially compressed. The upper and lower subs 26, 28 thus act as a pair of compression members to activate the packer sealing element 30. This axial compression causes the energizing elements 54, 56, 58 to be energized radially outwardly and urge the sealing surface 50 of the thermoplastic component 44 into sealing engagement. The retaining rings 32 are compressed axially as well, and the hinged portions 42 will flex to allow radial expansion of the sealing element 30 while the sealing element retaining flanges 36 retain the packer sealing element 30 against the outer surface of the tubing string 18. Because the central energizing element 56 is softer than the two energizing elements 54, 58 located on either side of it, the central energizing element 56 will be more easily compressed and, thus, extrude radially outwardly to a greater degree than the other two energizing elements 54, 58. This results in the central portion 60 of the sealing surface 50 being urged into greater engagement with the surrounding casing 16. Locking means, such as a body lock ring, locking dog, or other known devices (not shown), may be used to secure the packer assembly 24 in its set position.

Ordinarily, the packer device 24 would be set within a string of steel casing lining the interior of a wellbore. However, a suitably sized packer device incorporating a packer sealing element constructed in accordance with the present invention could also be set within an inner production tubing string or liner. Alternatively, the "surrounding tubular" might be the uncased surface of a section of open hole within a wellbore.

Those of skill in the art will recognize that numerous modifications and changes may be made to the exemplary designs and embodiments described herein and that the invention is limited only by the claims that follow and any equivalents thereof.

What is claimed is:

1. A packer sealing element for use within a packer device to form a fluid seal with a surrounding tubular, the packer sealing element comprising:

a thermoplastic component having a sealing surface to form a fluid seal with a surrounding tubular and an energizing chamber that is defined within the thermoplastic element; and a plurality of compressible energizing elements disposed within the energizing chamber for urging the sealing surface of the thermoplastic component into sealing engagement with the surrounding tubular.

2. The packer sealing element of claim 1 wherein at least one of the plurality of energizing elements is softer than the other energizing elements.

3. The packer sealing element of claim 1 wherein at least one of the energizing elements is formed substantially of elastomer.

4. The packer sealing element of claim 1 wherein the thermoplastic component is formed substantially to polytetrafluoroethylene polymer.

5. The packer sealing element of claim 1 wherein the thermoplastic component is formed substantially of polyetheretherkeytone.

6. A packer assembly for forming a fluid seal with a surrounding tubular comprising:

a central tubular member;

an axially compressible sealing element annularly surrounding the central tubular member and comprising:

a thermoplastic component having a sealing surface for forming a fluid seal against the surrounding tubular and an energizing chamber that is defined within the thermoplastic element;

an axially compressible energizing component disposed within the energizing chamber that urges the sealing surface of the thermoplastic component into sealing engagement with the surrounding tubular;

a pair of compression members located on either axial side of the sealing element, the compression members being axially moveable toward one another upon the tubular member to cause the sealing element to be energized into sealing engagement with the surrounding; and the thermoplastic component further includes a leg portion that is disposed between the energizing component and the central tubular member.

7. The packer assembly of claim 6 further comprising a retaining ring located between the sealing element and each compression member.

8. The packer assembly of claim 7 wherein the retaining rings each have a flange for retaining the sealing element against the tubular member.

9. The packer assembly of claim 7 wherein the retaining rings each have a hinged portion that flexes to allow the sealing element to expand radially outwardly during axial compression.

10. The packer assembly of claim 7 wherein the energizing component is substantially comprised of elastomer.

11. The packer assembly of claim 7 wherein the energizing component comprises a plurality of elastomeric elements, at least one of which has a different degree of softness from another of the elastomeric elements.

12. The packer assembly of claim 7 wherein the thermoplastic component is substantially comprised of polytetrafluoroethylene polymer.

13. The packer assembly of claim 7 wherein the thermoplastic component is substantially comprised of polyetheretherkeytone.

14. A packer assembly for forming a fluid seal with a surrounding tubular comprising:

a central tubular member;

an axially compressible sealing element annularly surrounding the central tubular member and comprising:

a thermoplastic component having a sealing surface for forming a fluid seal against the surrounding tubular and an energizing chamber that is defined within the thermoplastic element;

an axially compressible energizing component having a plurality of elastomeric elements, at least one of which has a different degree of softness from another of the elastomeric elements, the energizing component being disposed within the energizing chamber to urge the sealing surface of the thermoplastic component into sealing engagement with the surrounding tubular; and a pair of compression members located on either axial side of the sealing element, the compression members being axially moveable toward one another upon the tubular member to cause the sealing element to be energized into sealing engagement with the surrounding tubular.

15. The packer assembly of claim 14 wherein the thermoplastic component is substantially comprised of polytetrafluoroethylene.

16. The packer assembly of claim 14 wherein the thermoplastic component is substantially comprised of polyetheretherkeytone.

17. The packer assembly of claim 14 further comprising a retaining ring located between the sealing element and each compression member.

18. The packer assembly of claim 17 wherein the retaining rings each have a flange for retaining the sealing element against the tubular member.

19. The packer assembly of claim 17 wherein the retaining rings each have a hinged portion that flexes to allow the sealing element to expand radially outwardly during axial compression.

* * * * *

UNITED STATES PATENT AND TRADEMARK OFFICE

CERTIFICATE OF CORRECTION

PATENT NO. : 7,360,590 B2
APPLICATION NO. : 11/118013
DATED : April 22, 2008
INVENTOR(S) : Kossa et al.

It is certified that error appears in the above-identified patent and that said Letters Patent is hereby corrected as shown below:

At Column 5, line 3, the phrase "the surrounding; and" should read --the surrounding tubular; and--

Signed and Sealed this

Fifteenth Day of July, 2008

JON W. DUDAS
*Director of the United States Patent and Trademark Office*